United States Patent [19]

Böhm et al.

[11] Patent Number: 4,754,731

[45] Date of Patent: Jul. 5, 1988

[54] PISTON OF LIGHT METAL

[75] Inventors: Gerhard Böhm, Stein; Helmut Zweck, Nuremberg, both of Fed. Rep. of Germany

[73] Assignee: Alcan Aluminiumwerk Nürnberg GmbH

[21] Appl. No.: 891,203

[22] Filed: Jul. 28, 1986

[30] Foreign Application Priority Data

Jul. 31, 1985 [DE] Fed. Rep. of Germany ..... 3527447

[51] Int. Cl.[4] ..... F02F 3/08

[52] U.S. Cl. ..... 123/193 P; 92/222

[58] Field of Search ..... 123/193 P; 92/222, 208

[56] References Cited

U.S. PATENT DOCUMENTS 3,094,903 6/1963 Zollner ..... 92/222

3,190,273 6/1965 Bachle et al. ..... 92/222

*Primary Examiner*—Willis R. Wolfe, Jr.

*Assistant Examiner*—M. Macy

*Attorney, Agent, or Firm*—Cooper & Dunham

[57] ABSTRACT

Light-metal piston for combustion engines, having a sleeve-like insert embedded therein and controlling its heat expansion and being formed of a metal of smaller heat expansion coefficient than the piston base material. The insert is arranged in the solid material of the piston crown and extends around the entire piston periphery. Behind the insert, the piston base material is self-contracted to form a gap delimited by the insert on one side. On at least one edge or one side, the insert is not covered by piston base material, i.e. it extends up to the piston surface, this occurring however only in certain segments and not along the entire piston periphery. In the other segments, the insert lies beneath the piston surface and is thus covered by piston base material. To the extent that the insert is exposed on the piston end face, it is provided with an edge zone covering the depth of the self-contraction gap.

22 Claims, 15 Drawing Sheets

PISTON OF LIGHT METAL

The invention relates to a light-metal piston for combustion engines comprising a self-contained sleeve-like insert, which controls its heat expansion and consists of a metal of lower heat expansion coefficient than the base material of the piston (the piston base body), which insert extends around the entire piston periphery and is not covered by piston material on at least one edge, i.e. touches one piston surface, the piston base material being self-contracted behind the insert to form a gap delimited by the insert on one side.

Such pistons are already known (e.g. DE-AS No. 10 73 257 and DE-AS No. 10 78 387). In these pistons, the insert consists of a metal sleeve, a metal strip or a metal ring which is cast into the base material of the piston skirt at that position at which a control effect is desired in the region of the piston skirt. Upon cooling after casting, in this known piston the base material of the piston skirt located inside the insert contracts away from the control insert as a result of its larger heat expansion coefficient, so that a gap forms between the self-contracted piston base material and the control insert, whilst the piston base material located externally of the control insert shrinks onto the insert thus causing prestressing. Since the temperatures occuring in the piston skirt during casting of the control insert into the piston skirt are not achieved again during engine operation, the contraction is only partially retrieved during engine operation, so that the gap internally of the control insert produced upon cooling of the freshly cast piston by contraction is not completely restored. As a result, the piston base material located externally of the control insert is not affected in the control region by the piston base material lying within the control insert. Rather, on the occurrence of the temperatures appearing during engine operation and the resulting thermal expansion of the piston base material located externally of the control insert and shrunk onto this, pretensioning of the material is first taken up. Only then does actual expansion of this exterior piston base material take place with actual expansion of the exterior dimension of the piston in the control region, so that in the so-called control region between cold start and operational temperature only small diametral changes occur on the piston. As a result of this, the piston clearance can remain small.

As already explained in the foregoing, in the known pistons, however, such control inserts are arranged only in the piston skirt since it was felt to be impracticable to arrange such control inserts in the piston crown consisting of solid material. That is to say, control of the solid piston head was thought to be impossible for the reason that this cannot give elastically in response to a rigid control insert. Control according to the principle of self-contraction of the piston base material away from the one side of the control insert was held to be impossible in the piston head because this principle only achieves its functioning without problems if the control insert is uncovered in the control region, i.e. has exposed sides or edges on the piston surface which are not covered by piston base material. This is because only in this case is the piston base material on the one side of the control insert not directly connected to that on the other side of the control insert so that the piston materials on the two sides of the control insert can shrink or expand independently of one another, which is a prerequisite for the effectiveness of this control.

By exposing the control insert on its sides or edges, problems however result on the piston head in respect of the fatigue strength of the relatively thin sleeve-like external piston base material located on the outer side of the control insert, this possibly leading to shedding of this external material sleeve and possibly even of the control insert bounding this. Moreover, oil may enter into the gap existing on the one side of the control insert and remain even during engine operation in this control system as a result of self-contraction of the piston base material, which oil is carburised at the high combustion temperatures and deposited as oil carbon, as a result of which the gap gradually reduces and the control effect is progressively limited and eventually prevented.

For this reason, control only in the region of the piston skirt has been accepted. In order to prevent damage to the uncontrolled piston body as a result of temperature-induced diametral enlargement during full-load operation, a large clearance must be provided between the piston head and the cylinder wall during assembly. This has the consequence that when the engine is cold the piston tilts and rattles as a result of inadequate head guidance and the top land is strongly loaded by hot combustion gases with the danger of carburising of the top land and high abrasion of the first piston ring groove. Attempts have been made to prevent the mentioned disadvantages of necessarily large head clearance by various measures. Thus, means for piston head cooling have been provided, for example in the form of heat conducting metal inserts (DE-PS No. 554 865), by spraying with oil (DE-PS No. 25 39 470) or by the provision of cooling channels (DE-PS No. 24 35 377). For improved protection of the first ring groove, the top land height has been increased and groove shielding cast into the piston (DE-OS No. 24 10 140), also in conjunction with cooling channels. Also pistons are known with enlarged piston head clearance whose grinding finish is so arranged that the piston head achieves rolling rather than knocking.

All these previously attempted solutions are unable however satisfactorily to avoid the mentioned disadvantages.

The invention is based on the recognition that in particular in currently used pistons which are relatively short in the axial direction, thus pistons with short skirts, controlling the skirt region is insufficient to maintain the operational clearance and in particular the tilting clearance of the piston as small as possible, to prevent or exclude tilting and rattling noises and abrasive consequences as far as possible and to prevent carburising of the top land, preferably across the pin bosses. The invention is therefore based on the object of providing a piston of the type mentioned in the introduction which not only has small operational clearance in the region of the piston skirt but also a low operational and tilting clearance in the region of the piston crown, in order to prevent tilting and rattling of the piston with consequential abrasion and carburising of the top land as far as possible.

This object is achieved in accordance with the invention with pistons of the above mentioned type in that a control insert is arranged in the solid material of the piston crown and at least on one of its edges or sides is exposed in predetermined segments of the piston periphery, but lies in the other segments beneath the piston surface, i.e. is completely covered by piston base material, and is anchored therein in form-locking manner, and in that the insert, to the extent that it is exposed on the piston end surface, is provided with an edge zone covering the depth of the self-contraction gap.

Thus, the following advantages or effects are ensured:

1. Covering of the self-contraction gap for preventing its closure with oil carbon.
2. Achieving of locally limited and thus precise control by exposing the control insert only in predetermined segments of the insert.
3. Solid anchoring of the control insert in its remaining segments in the piston material by its sleeve-like construction and all-round embedding in the piston base material beneath the piston surface in order to prevent throwing of the insert or parts of the piston base material away from the piston, which can hardly be prevented with completely exposed inserts.

As a result of the self-contraction of the piston base material within the sleeve-like control insert and the control strips of piston base material on the exterior of the insert which are very thin compared with the uncontrolled piston head, the piston crown achieves elasticity which was not previously achievable, whereby instead of impacting on the cylinder wall the piston achieves elastic resilient passage and the danger of damage due to seizing of the piston is further reduced.

The insert can for example be exposed with its one lower edge or its lower side on the piston side wall or in a piston ring groove. It can also be expedient if in cross-section the insert has a bend or rounded portion and lies with this or with its entire exterior surface against the side wall of the piston, thus being exposed to this. It is also possible to provide at least part of the ring groove having one of the exposed ends of the control insert with a protective sheath.

Further advantageous embodiments of the piston according to the invention will be apparant from the claims and from the drawings.

Figure 1:
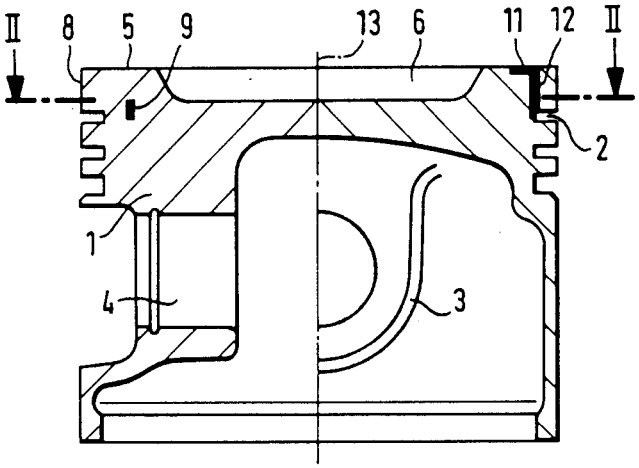
FIG. 1 shows a first embodiment of the piston according to the invention in axial section through the piston, the left half of the drawing showing a section which extends perpendicular to that of the right half of the drawing.

In the drawings, in all exemplary embodiments, the piston with its base material is provided with reference numeral 1, the upper ring groove with reference numeral 2, the pin boss with reference numeral 3 and the pin hole with reference numeral 4. In all exemplary embodiments, the end face of the piston 5 is recessed to form a central combustion chamber 6. The side wall of the piston has reference numeral 8. In the drawings, in each case the self-contraction gap, which is located on the inner side of the control insert facing the main axis 13 of the piston, is not represented.

Figure 2:
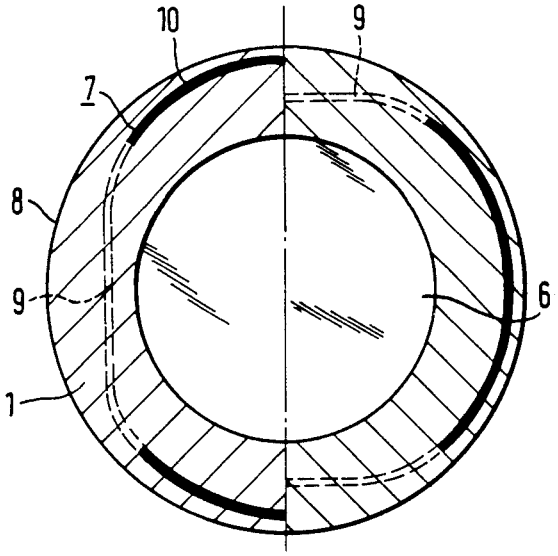
FIG. 2 shows a cross-section through the embodiment according to FIG. 1 and along the line II—II in FIG. 1.
Figure 3:
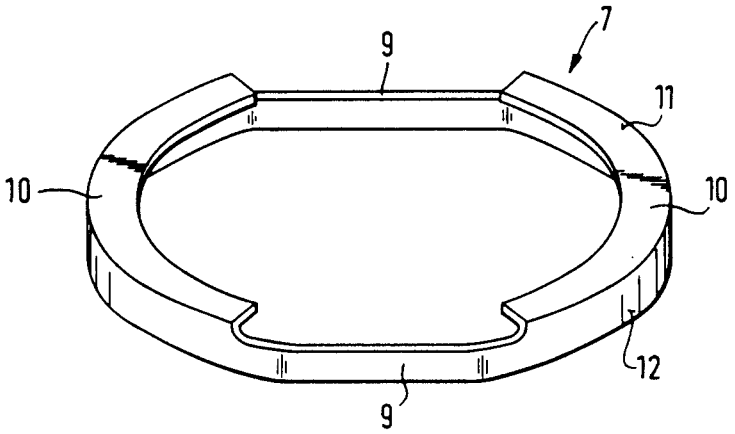
FIG. 3 shows an enlarged perspective view of the control insert in this exemplary embodiment according to FIGS. 1 and 2.

In the exemplary embodiment illustrated in FIGS. 1 to 3, the insert 7 extends slightly within (beneath) the side wall 8 of the piston in annular fashion along the entire piston periphery, its annular form being straight on two oppositely lying segments 9 so that in these segments of the piston head the insert is located at a slightly greater spacing from the side wall 8 of the piston than in its arcuate segments 10. In its arcuate segments, this insert is provided in cross-sections of the sleeve with an L-shape, the one cross-sectional limb 11 being located on the end surface 5 of the piston and covering the self-contraction gap, which is not illustrated, on the inner side of the insert. The sleeve-like insert is thus exposed with this limb 11 on the end surface of the piston. With the edge of its other limb 12, this insert is exposed in the said segment in the ring groove 2 of the piston.

In its two other oppositely lying straight segments 9, the insert is reduced in its cross-section from its otherwise L-shape to a relatively small part of the L-limb 12 in such manner that this segment 9 is on all sides embedded and anchored in the piston base material 1 in a form-locking manner.

In the exemplary embodiment illustrated in FIGS. 1 and 2, the segments 9 of the insert 7 having a straight and small cross-section are located above the pin bosses 3, whilst the regions 10 of the insert having an L-shaped cross-section are offset in relation to the main axis 13 of the piston by 90 degrees thereto in the piston cross-section so that they lie laterally above the pin posses 3.

Figure 4:
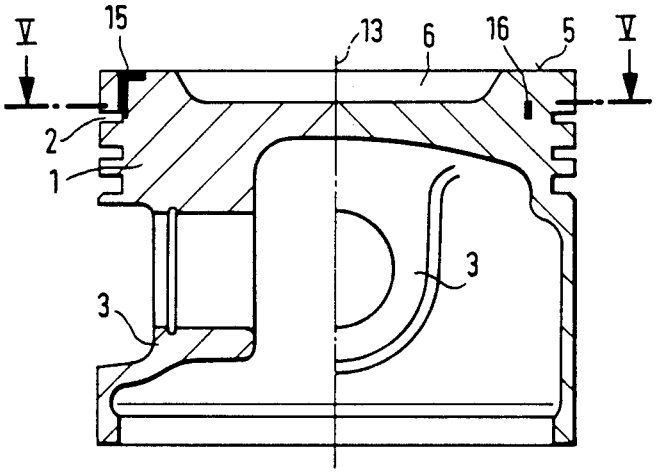
FIG. 4 shows a second exemplary embodiment in the same mode of representation as in FIG. 1.
Figure 5:
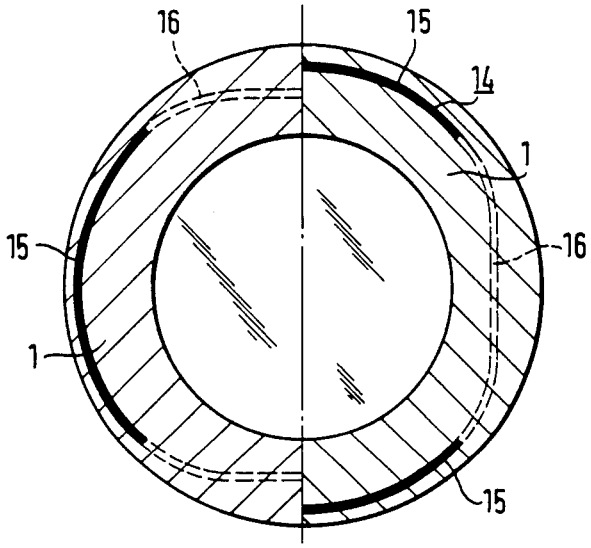
FIG. 5 is a cross-section along the line V—V in FIG. 4.

In the examplary embodiment illustrated in FIGS. 4 and 5, the insert 14 has the same shape as the insert 7 in the exemplary embodiment according to FIGS. 1 and 2. It is also arranged in the piston in the same manner as in this exemplary embodiment with the exception that the segments 15 with enlarged L-shaped cross-section are located above the pin bosses 3, whilst the straight segments 16 having the reduced cross-section are offset by 90 degrees in the piston cross-section and lie laterally of and above the pin bosses 3.

Figure 6:
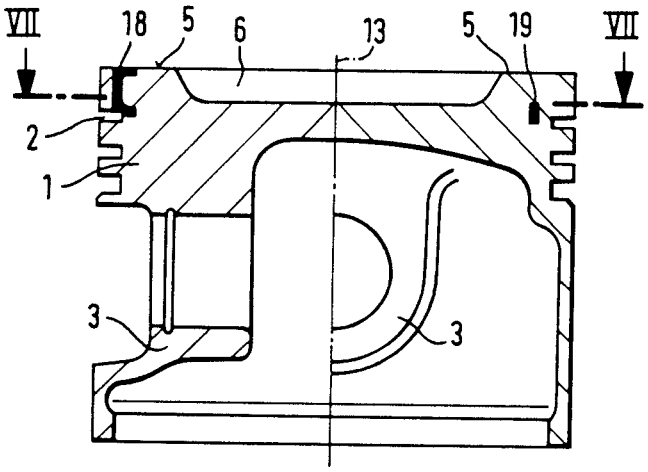
FIG. 6 shows a third embodiment in the same mode of representation as FIG. 1.
Figure 7:
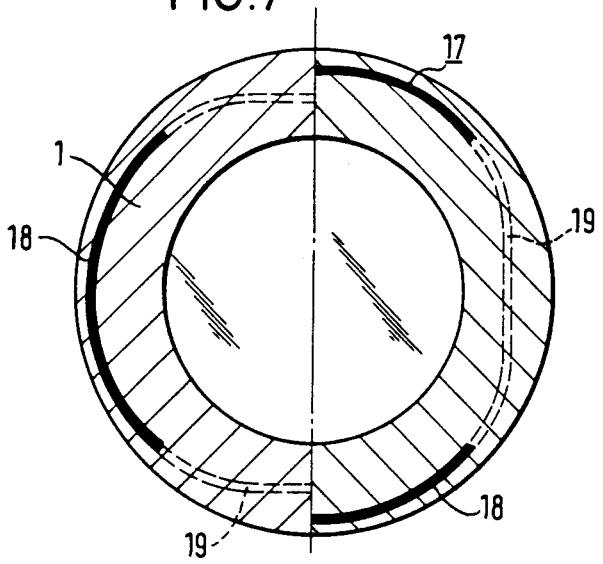
FIG. 7 is a cross-section along line VII—VII of FIG. 6.

The exemplary embodiment according to FIGS. 6 and 7 has an insert 17 which has U-shaped cross-section in its arcuate segments 8 located above the pin bosses 3, which cross-section is exposed with its upper limb which covers the self-contraction gap on the end surface of the piston 5 and with its lower limb in the upper ring groove 2. In its straight segments 19, the insert 17 is limited in cross-section to the lower part of the U-shaped land.

Figure 8:
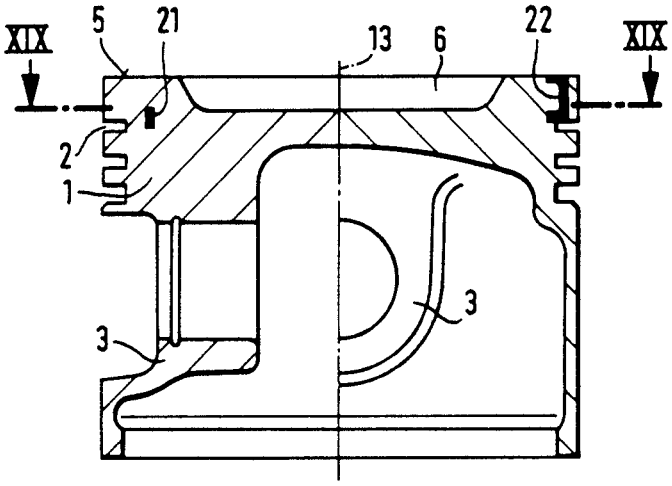
FIG. 8 shows a fourth embodiment in the same mode of representation as FIG. 1.
Figure 9:
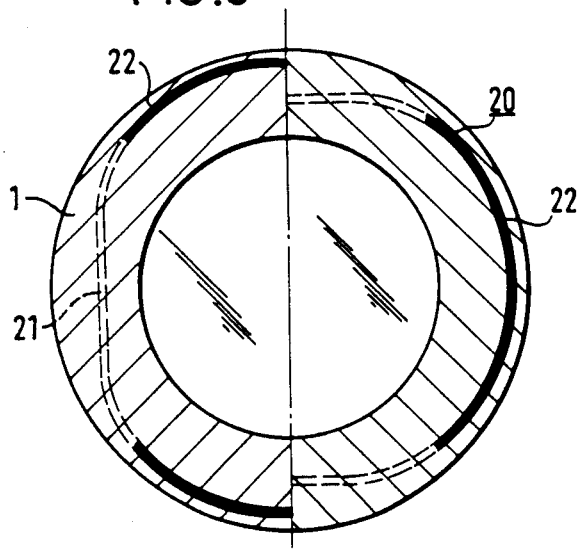
FIG. 9 is a cross-section along line IX—IX in FIG. 8.

The exemplary embodiment according to FIGS. 8 and 9 is distinguished from that according to FIGS. 6 and 7 only in that the insert 20 is located with its straight segments 21 above the pin bosses 3 and with its segments 22 located therebetween is located laterally above the pin bosses 3.

Figure 10:
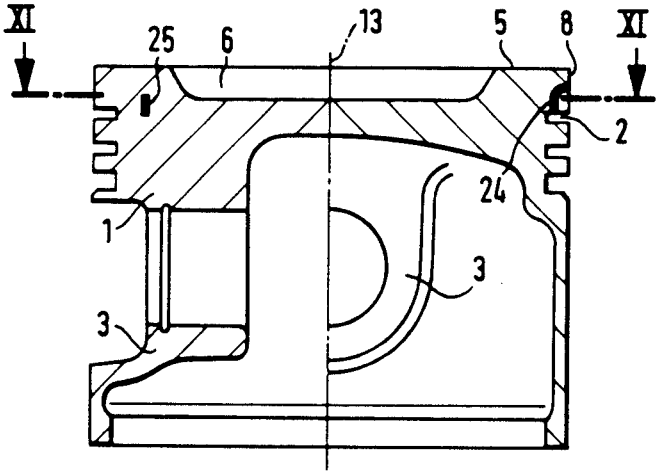
FIG. 10 shows a fifth embodiment in the same mode of representation as FIG. 1.
Figure 11:
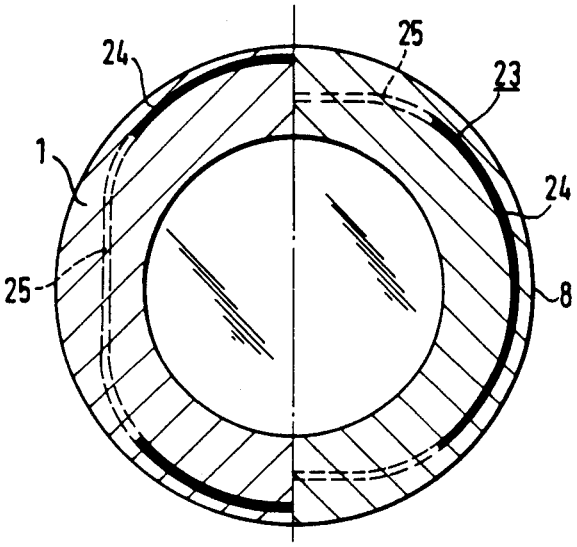
FIG. 11 is a cross-section along line XI—XI in FIG. 10.

Also in the exemplary embodiment according to FIGS. 10 and 11, the insert 23 extends annularly at a small spacing within the piston side wall 8 around the periphery of the piston and has two arcuate segments 24 and two straight segments 25 lying therebetween. In the arcuate segments, the insert 23 has larger cross-section than in its straight segments 25, being curved in its upper cross-sectional region in the direction of the side wall 8 of the piston and being exposed on this side wall of the piston. With its lower edge, it is exposed in this segment in the ring groove 2 of the piston. In its straight segments 25, this insert 23 has a reduced cross-section which corresponds to the cross-sectional part of the insert located beneath the above-mentioned curved portion in the arcuate segment 24.

The insert is in all of its segments mounted beneath the end face 5 of the piston in the piston base material 1 and therefore covered by this. A self-contraction gap open to the combustion chamber is therefore not present in this embodiment either. In its straight segments 25, the insert is completely surrounded by piston base material with the piston side wall and also is not exposed at a piston ring groove.

In this exemplary embodiment, the straight segments 25 of the insert 23, embedded on all sides in the piston base material 1, are located above the pin bosses 3, whilst the exposed segments 24 are offset in relation to the main piston axis 13 by 90 degrees thereto in the piston cross-section.

Figure 12:
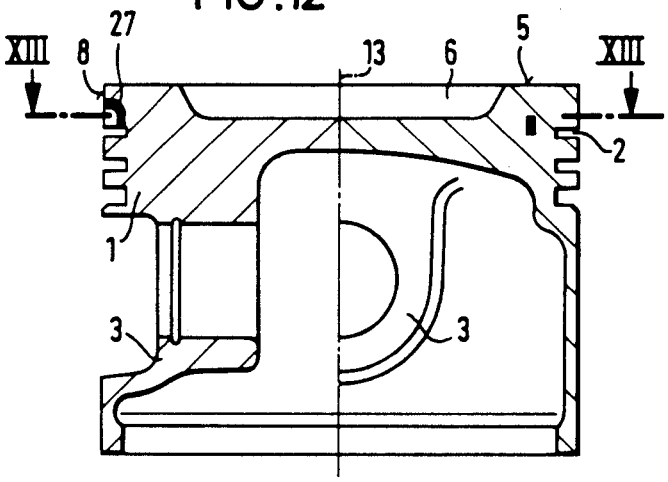
FIG. 12 shows a sixth embodiment in the same mode of representation as FIG. 1.
Figure 13:
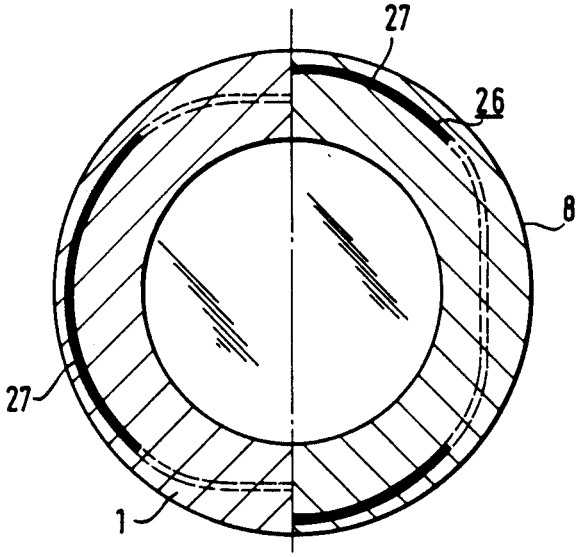
FIG. 13 is a cross-section along line XIII—XIII in FIG. 12.

In the exemplary embodiment illustrated in FIGS. 12 and 13, the insert 26 has the same shape as the insert 23 in the examplary embodiment according to FIGS. 10 and 11. It is however so arranged in the piston crown that its exposed arcuate segment 27 is located above the pin bosses 3.

Figure 14:
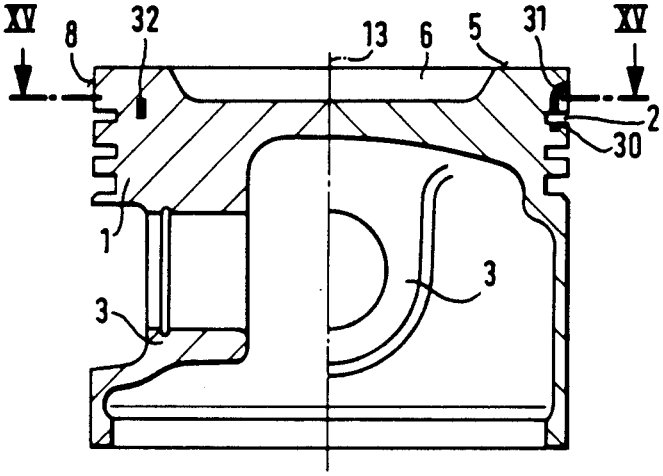
FIG. 14 shows a seventh embodiment in the same mode of representation as FIG. 1.
Figure 15:
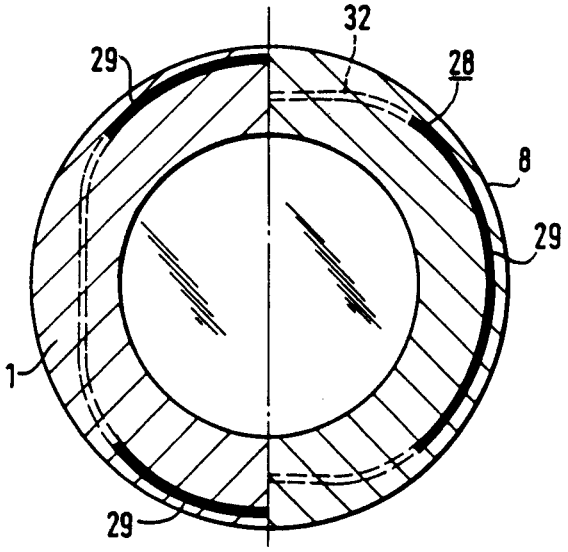
FIG. 15 is a cross-section along line XV—XV in FIG. 14.

The exemplary embodiment according to FIGS. 14 and 15 is distinguished from that according to FIGS. 10 and 11 only in that the insert 28 is provided with a cross-sectional portion 30 in its arcuate segment 29, which portion 30 is located beneath the upper piston ring groove 2 and shields this, the portion 30 being connected with the straight segments 32 in the same manner as the upper cross-sectional component 31.

In this exemplary embodiment, the arcuate segments 29 of the insert 28 are located with their entire cross-section laterally above the pin bosses 3, whilst the straight segments 32 having small cross-section lie across the pin bosses 3. It is however also possible to reverse the position of the various segments 28, 32.

Figure 16:
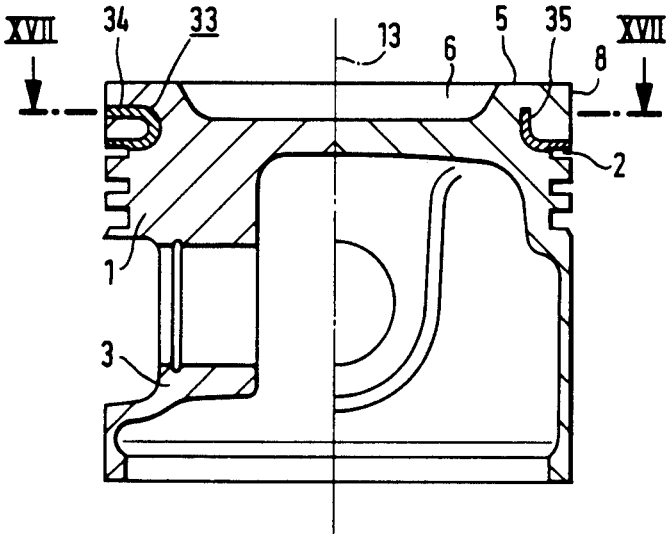
FIG. 16 shows an eighth embodiment in the same mode of representation as FIG. 1.
Figure 17:
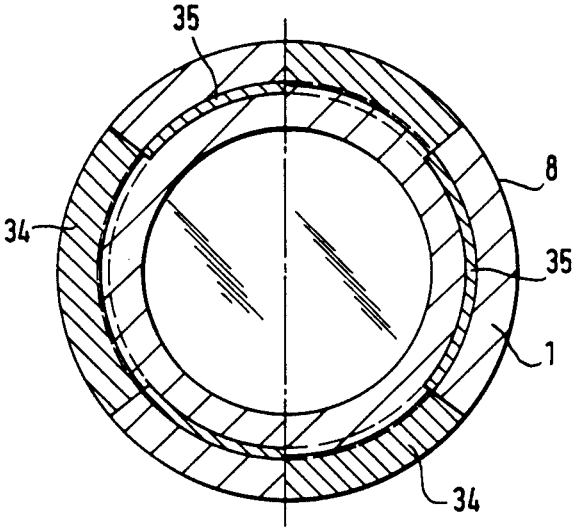
FIG. 17 is a cross-section along line XVII—XVII in FIG. 16.

Also in the exemplary embodiment according to FIGS. 16 and 17, the control insert 33 is not exposed on the piston end face 5, but rather on the piston side wall 8, whereby the self-contraction gap opposite the combustion chamber is covered by the piston base material 1. The insert is constructed from two oppositely lying segments 34 located across the pin bosses 3 and having U-shaped cross-section, the edges of the U-limbs being exposed on the side wall 8 of the piston. The lower U-limb is exposed also in the upper piston ring groove 2.

In the two other segments 35, which are located laterally above the pin bosses 3, the insert 33 is reduced in cross-section approximately to the lower cross-sectional half of the two other segments 34, so that the insert is exposed in these segments only with its lower edge in the piston ring groove 2 and on the piston side wall 8.

Figure 18:
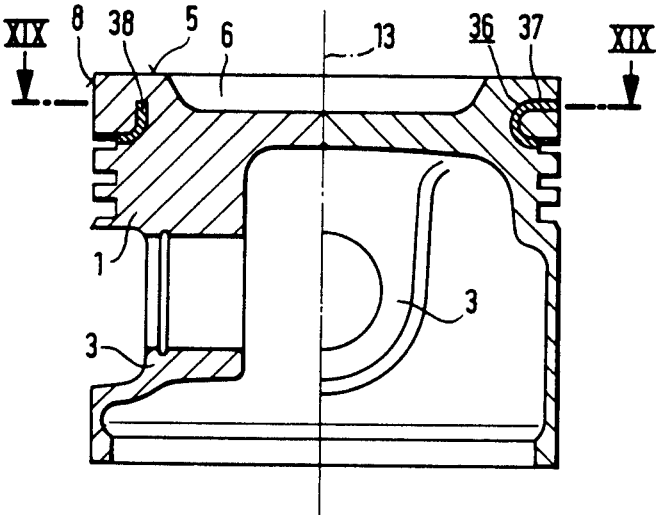
FIG. 18 shows a ninth embodiment in the same mode of representation as FIG. 1.
Figure 19:
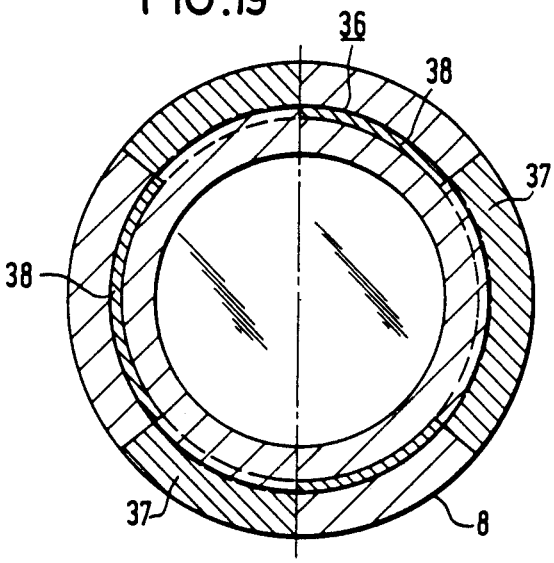
FIG. 19 shows a cross-section along line XIX—XIX in FIG. 18.

The embodiment according to FIGS. 18 and 19 is distinguished from that of FIGS. 16 and 17 only in that the insert 36 with its segment 37 having U-shaped cross-section is located laterally above the pin bosses 3 and is located with its segment 38, which has cross-section reduced approximately to that of the lower half of this U-shaped cross-section, positioned across the pin bosses 3.

Figure 20:
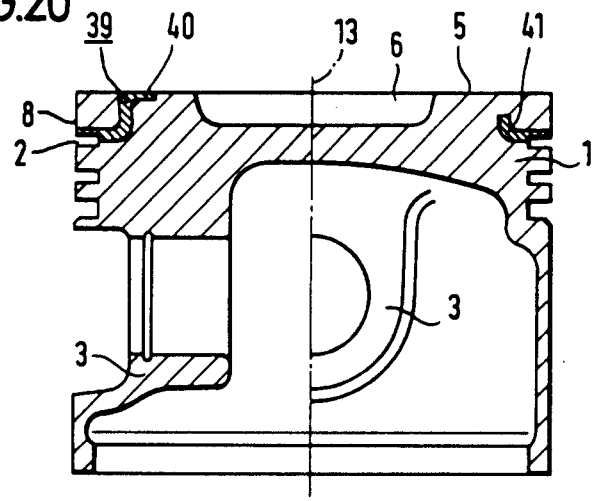
FIG. 20 shows a tenth embodiment in the same mode of representation as FIG. 1.
Figure 21:
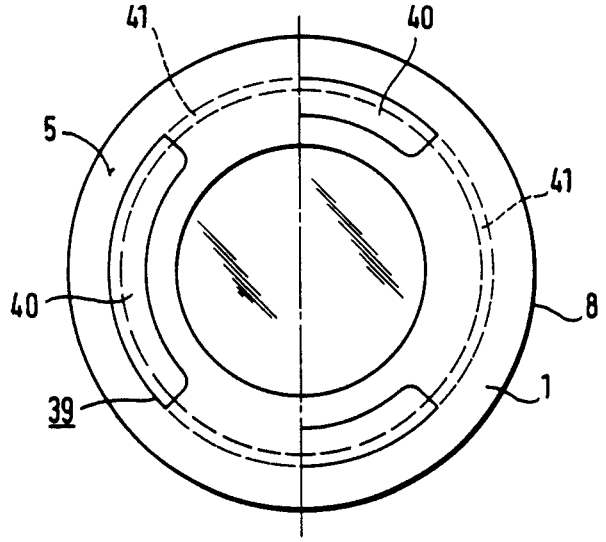
FIG. 21 is a plan view of the end surface of the piston of the piston in this embodiment.
Figure 22:
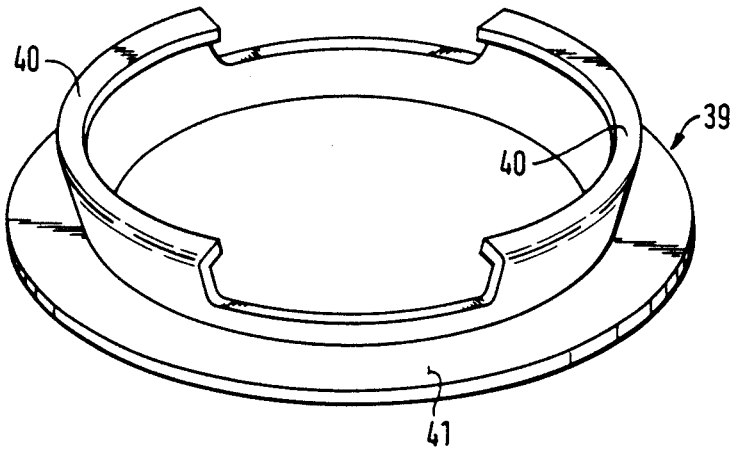
FIG. 22 is an enlarged perspective view of the insert according to FIGS. 20 and 21.

The exemplary embodiment according to FIGS. 20 to 22 is distinguished from that according to FIGS. 16 and 17 only in that there the insert 39 has S-shape in the two segments located across the pin bosses 3, the upper S-limb 40 being exposed on the end face 5 of the piston and the lower S-limb being exposed at the side wall 8 of the piston and in the upper ring groove 2. In its two other segments 41, which are located laterally above the pin bosses 3, the insert 39 is reduced in cross-section to that of the lower half of the S-shaped cross-section provided in the above mentioned segments, so that there the insert is exposed only on the side wall 8 of the piston and in the upper ring groove 2. The self-contraction gap is thus covered in both segments of S-cross section by the upper S-limb 40 and in the two other segments 41 by the piston base material 1.

Figure 23:
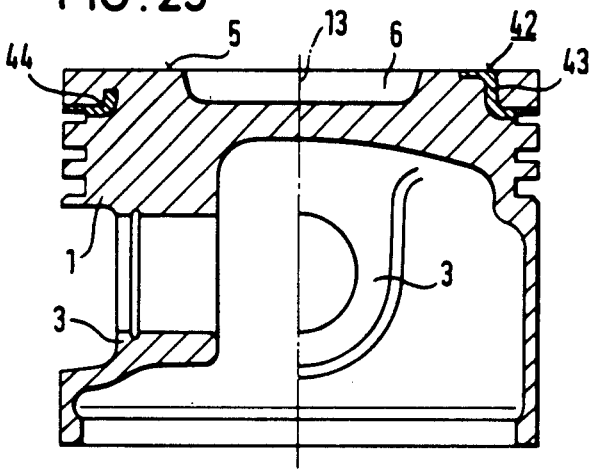
FIG. 23 shows an eleventh embodiment in the same mode of representation as FIG. 1.
Figure 24:
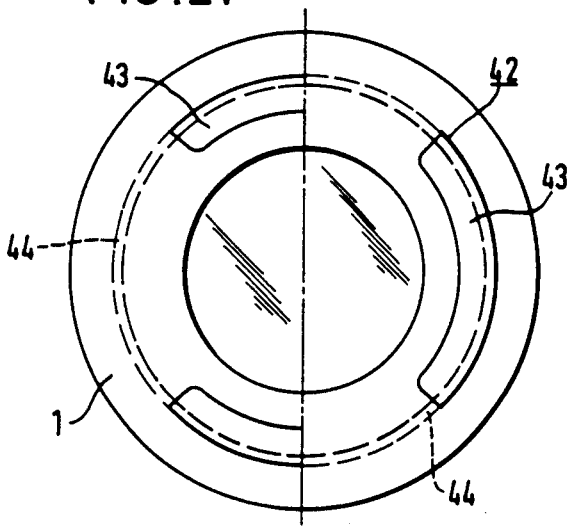
FIG. 24 is a plan view of the end surface of the piston of this embodiment.

The exemplary embodiment according to FIGS. 23 and 24 has an insert 42 which is of the same configuration as the exemplary embodiment according to FIGS. 20 and 21, but however this insert is arranged with its complete segment 43 having S-cross-section laterally across the pin bosses 3, whilst its segments 44 having reduced cross-section are located directly across the pin bosses 3.

Figure 25:
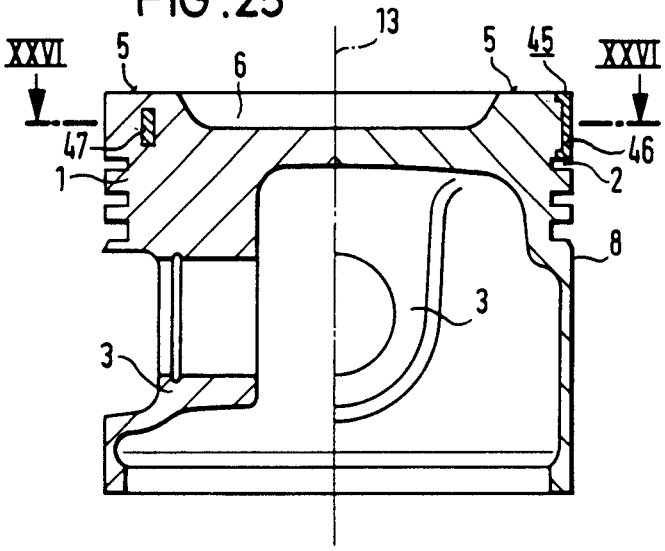
FIG. 25 shows a twelfth embodiment in the same mode of representation as FIG. 1.
Figure 26:
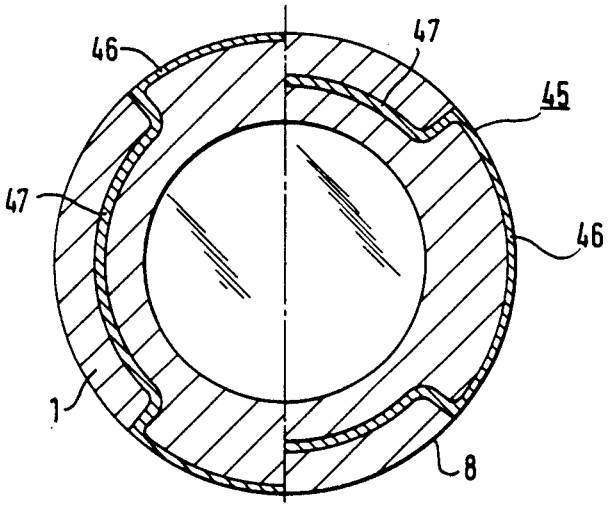
FIG. 26 is a cross-section along line XXVI—XXVI in FIG. 25.

FIGS. 25 and 26 show an exemplary embodiment in which the insert 45 has U-shaped cross-section in the two segments 46 lying laterally above the pin bosses 3 and is exposed with its entire exterior side at the side wall 8 of the piston, its upper U-limb being exposed at the end face 5 of the piston and its lower U-limb in the upper ring groove 2.

Its segments 47 located across the pin bosses 3 lie at a certain spacing within the side wall 8 of the piston. In these segments, the insert has rectangular cross-section of smaller dimensions than in its other segments 46, the insert being surrounded on all sides by piston base material 1 and thus being securely anchored in this.

The essential desired effect of this type of insert is associated with the self-contraction of the piston base material located on the inner side of the insert. The second effect of such control sleeves, that is to say placing the layer of piston base material located on the exterior side of the control insert under tension by shrinking onto the insert at lower temperatures and thus rendering a portion of its expansion ineffective upon subsequent heating in engine operation, is considerably improved in the last mentioned exemplary embodiment in that the outer layer of the piston base material is completely omitted in segments and having regard to the clearance between the piston crown and the cylinder wall in the engine only the smaller expansion coefficient of the material of the control insert is there effective.

Figure 27:
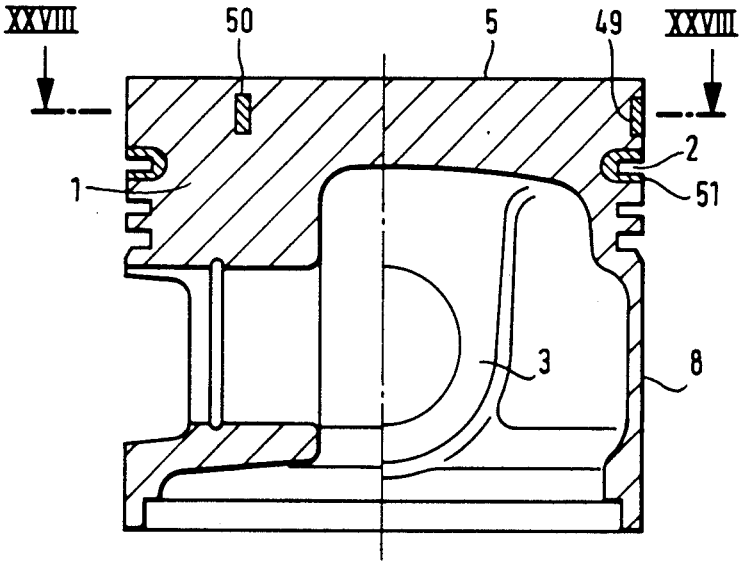
FIG. 27 is a thirteenth embodiment in the same mode of representation as FIG. 1.
Figure 28:
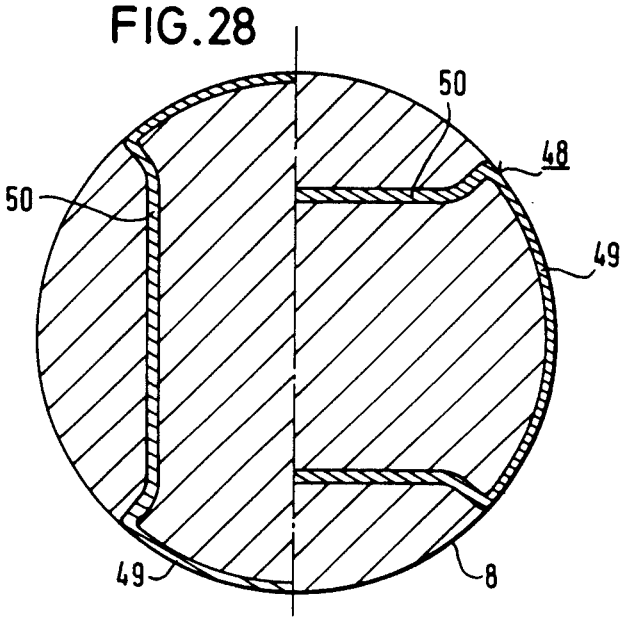
FIG. 28 shows a cross-section along line XXVIII—XXVIII in FIG. 27.

In the exemplary embodiment according to FIGS. 27 and 28, the control insert 48 has two circularly arcuate segments 49 in which the insert has rectangular cross-section and is exposed with its entire outer side at the piston exterior surface 8. Furthermore, it comprises two segments 50 located across the pin bosses 3, likewise of rectangular cross-section, which extend in a straight line within the piston side wall 8 and are surrounded on all sides by piston base material and are thus securely anchored in this.

The upper ring groove 2 is in the illustrated embodiment provided with additional U-shaped shielding 51 in the ring cross-section, as is usual with the state of the art, in particular with pistons for diesel engines.

What is claimed is:

1. Piston for combustion engines comprising a sleeve-like insert embedded in the material of the piston crown for controlling heat expansion thereof and being of a metal of smaller heat expansion coefficient than the basic crown material, which insert extends around the entire piston periphery and is exposed on at least one piston surface, the piston material being self-contracted behind the insert to form a gap delimited by the insert on one side, and the insert having at least one surface which is exposed only in certain segments of the piston periphery and lying embedded in the other segments beneath the piston surface.

2. Piston according to claim 1 wherein the insert is exposed on the piston end face and is provided with an edge zone covering the width of said gap.

3. Piston according to claim 1 wherein the insert is exposed on the piston side wall.

4. Piston according to claim 3 wherein the sleeve-like insert is exposed at the piston side wall in certain segments with its entire outward-facing surface.

5. Piston according to claim 3 wherein the insert cross-section has a bend and is exposed on the piston side wall.

6. Piston according to claim 2 wherein said insert is exposed with its one edge at the piston end face and with its other edge at the piston side wall.

7. Piston according to claim 1 wherein the insert is exposed with its lower edge at a piston ring groove.

8. Piston according to claim 1 wherein an edge of the insert is exposed along the entire periphery of a ring groove.

9. Piston according to claim 1 wherein the insert is formed in two mutually perpendicular sections containing the piston axis, each of which is symmetrical with reference to the piston axis.

10. Piston according to claim 1 wherein exposed segments of the insert are arranged asymmetrically with reference to the piston axis.

11. Piston according to claim 1 wherein the insert is segmentally exposed only at a single region of the piston periphery.

12. Piston according to claim 1 wherein the insert is exposed at two oppositely lying segments and therebetween lies beneath the surface of the piston.

13. Piston according to claim 12 wherein the segments of the insert lying beneath the surface of the piston are located substantially above pin bosses thereof.

14. Piston according to claim 12 wherein the exposed segments of the sleeve-like insert are located substantially above pin bosses thereof.

15. Piston according to claim 12 wherein each of the mutually oppositely lying exposed segments and the segments lying beneath the surface of the piston extends across approximately one quarter of the insert periphery.

16. Piston according to claim 1 wherein the insert has smaller dimensions in its segments lying beneath the surface of the piston than in its exposed segments.

17. Piston according to claim 1 wherein the exposed segments of the insert deviate from a circular shape relative to the segments completely enclosed by piston base material in the axial and/or radial direction.

18. Piston according to claim 1 wherein the insert extends in its exposed segments approximately circularly and in its segments located beneath the piston surface approximately in a straight line.

19. Piston according to claim 1 wherein the insert has L-shaped, U-shaped or S-shaped cross-section or the like in its exposed segments, a part of the L, U, or S-shape being absent in its unexposed segments.

20. Piston according to claim 1 wherein the insert is formed of sheet steel.

21. Piston according to claim 1 wherein the insert is manufactured from cast iron alloy.

22. Piston according to claim 1 wherein the surface of the sleeve-like insert is provided with a ribbed region, for example in the form of a waffle pattern.

* * * * *